United States Patent [19]

Logan et al.

[11] 4,127,915

[45] Dec. 5, 1978

[54] SNAP LOCK HANDLE

[76] Inventors: Thomas D. Logan, 3740 Dover Pl., Los Angeles, Calif. 90039; Edwin S. Nelson, 140 S. Buena Vista St., Apt. V, Burbank, Calif. 91505

[21] Appl. No.: 781,562

[22] Filed: Mar. 28, 1977

[51] Int. Cl.[2] ..... B65D 23/10; B65D 25/28

[52] U.S. Cl. ..... 16/114 R; 294/27 H; 294/33

[58] Field of Search ..... 16/110 R, 110 A, 114 R, 16/114 A, DIG. 24, DIG. 25; 215/100, 101; 224/45, 50; 294/27 H, 33

[56] References Cited

U.S. PATENT DOCUMENTS

| | | | |
|---|---|---|---|
| D. 232,614 | 9/1974 | Brown | 294/27 H |
| 1,209,676 | 12/1916 | Cooper | 294/27 H |
| 1,688,165 | 10/1928 | Tehel | 294/27 H |
| 2,128,466 | 8/1938 | Machotka | 16/114 A |
| 2,424,094 | 7/1947 | Herr | 16/114 A |
| 2,426,682 | 9/1947 | Hallstream | 294/27 H |
| 2,639,502 | 5/1953 | Wormelle | 16/114 A |
| 2,665,936 | 1/1954 | Moore | 16/114 A |
| 2,806,732 | 9/1957 | Montanaro | 294/33 |
| 3,189,937 | 6/1965 | Sciortino | 16/114 A |

*Primary Examiner*—Louis K. Rimrodt
*Attorney, Agent, or Firm*—Roger A. Marrs

[57] ABSTRACT

A snap lock handle is disclosed herein for releasable connecting onto the top and bottom ridges of a conventional can which includes a U-shaped member having a central hand gripping portion terminating at its opposite ends in connection elements outwardly cantilevered normal to the gripping portion. The ends of the connection elements are provided with transverse channels for insertably receiving the ridges of the can. The channels are defined by opposite legs wherein an outer leg is of elongated length so as to engage with the top and bottom of the can while the inner leg is flat or flush in one instance and hooked in the other so as to nest in the usual groove at the top of the can.

2 Claims, 3 Drawing Figures

Fig. 1
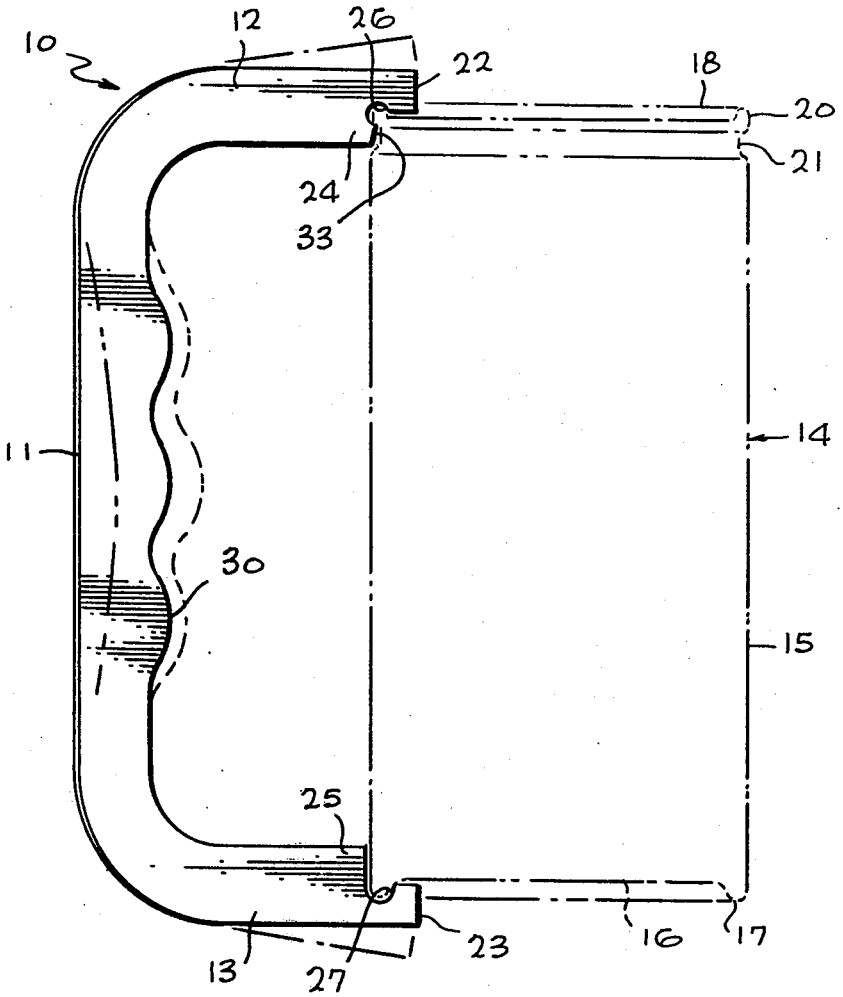
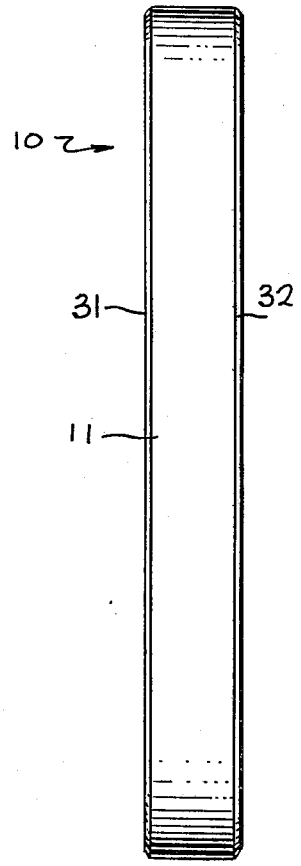
Fig. 2
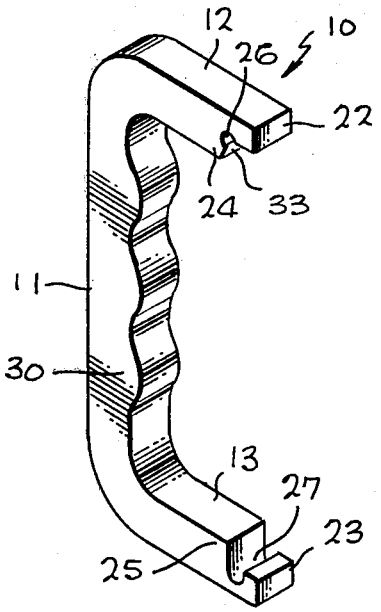
Fig. 3

SNAP LOCK HANDLE

BACKGROUND OF THE INVENTION

1. Field of the Invention

The present invention relates to portable or releasable handles for beverage containers or vessels and more particularly, to a novel detachable handle having internal bias for spring loading connecting elements into releasable engagement with the opposite ends of a beverage can.

2. Brief Description of the Prior Art

In the past, it has been the conventional practice to package liquids of an alcoholic or soft drink nature in metal cans. The cans are generally formed with a cylindrical central body of metal which is closed at its opposite ends by an integral bottom deformed into the hollow of the can so that a bottom ridge is present and by a separate top which is placed on the other end of the cylindrical body under a pressure metal deforming device which provides annular bead or ridge. Although these prior beverage containers have been successful in containing the beverage, problems in use have been encountered which stem largely from the fact that the beverage is refrigerated and the metal container is very cold to the hand of the user. Also, the cans are generally stored in a refrigerator or icebox which is a wet environment causing the exterior surface of the can to be slippery and difficult to grasp during consumation of the product.

Therefore, a long standing need has been present to provide a novel means for holding a can so that the consumer may have access to the contents thereof without actually touching the can.

SUMMARY OF THE INVENTION

Accordingly, the above problems and difficulties have been obviated by the present invention which provides a novel means for holding a beverage can while the user consumes the liquid product. The invention contemplates a snap lock handle having a central portion adapted to be gripped by the hand of the user and a pair of connection elements which are integrally formed at the opposite ends of the central portion and outwardly project normal to the central portion. The terminating ends of the connecting elements include snap lock means for releasably and yieldably gripping with the bottom ridge of the can and the top bead or ridge of the can. A feature resides in providing an internal bias through the selection of material so that the central portion is relatively stiff causing the opposite connecting portions or elements to spring towards one another.

Therefore, it is among the primary objects of the present invention to provide a novel snap lock handle that may be readily snapped on to the opposite ends of a beverage can so that the user may hold the can thereby.

Another object of the present invention is to provide a novel snap lock handle for beverage cans having an internal or self biasing aspect whereby connecting elements are normally urged into engagement with the top and bottom ridges of a beverage can.

Yet another object of the present invention is to provide a novel handle for a beverage can which simulates the handle of a mug.

A further object of the present invention is to provide an inexpensive handle means that may be readily installed on or removed from a conventional beverage can so that the user may hold the can via the handle means.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a side elevational view of the snap lock handle incorporating the present invention and illustrated in use on a typical beverage can;

FIG. 2 is an end elevational view of the handle shown in FIG. 1; and

FIG. 3 is a reduced perspective view of the novel snap lock handle of the present invention.

DESCRIPTION OF THE PREFERRED EMBODIMENT

Referring to FIG. 1, the novel snap lock handle of the present invention is illustrated in the general direction of arrow 10 which includes a central portion 11 having connecting elements 12 and 13 integrally formed at its opposite ends. The snap lock handle 10 is illustrated in use with a conventional beverage can 14 which includes a cylindrical central body 15 having a bottom 16 formed as a depression so as to provide a circular ridge 17. The opposite end of the beverage can 14 includes a top 18 which is held in place by means of a circular bead 20. Immediately beneath the bead 20 is a groove 21.

The terminating ends of the connecting elements 12 and 13 are provided with an outer leg 22 and 23 associated with connecting elements 12 and 13 and inner legs 24 and 25 respectively carried thereon. It is to be noted that the outer leg 22 and 23 are of elongated length so as to project over the respective bead 20 and ridge 17 so as to engage the respective top and bottom of the beverage can 14. Also, it is to be noted that the inner and outer legs of each connecting element define a transverse channel indicated by numerals 26 and 27 respectively. These channels are intended to releasably receive the bead 20 and the ridge 17 when the respective bead and ridge are inserted into the mating channel. The inner leg 24 is arranged to snap under the bead 20 into the groove 21. It is to be noted that the inner leg 25 is flush or flat so as to correspond with the adjacent side of the can.

The central portion 11 may be provided with rounded portions, such as indicated by numeral 30 which serves as finger grips for the hand of the user. As shown in broken lines, the connection elements 12 and 13 may be forced outwardly while the central portion 11 is bowed so that the outer legs may be displaced over the respective bead 20 and ridge 17. By fabricating the handle 10 from a suitable plastic or plastic-like material, an internal bias is set into action which spring loads or biases the connecting elements into engagement with the opposite ridges of the can. Such an arrangement also provides for a firm connection which will not readily come undone as the user moves the handle and can about.

In FIG. 2, the backside of the handle is illustrated and it also can be seen that the opposite edges along the central portion 11 are champered as indicated by the numerals 31 and 32.

Referring now in detail to FIG. 3, the novel snap lock handle 10 is illustrated in perspective view and it can be seen that the thickness of the handle is such as to provide adequate support for the connection elements 12 and 13 to grip and hold on to the top and bottom of the beverage can. Preferrably, the inner leg 24 associated with connection element 12 is champered as indicated by numeral 33 so as to more conveniently accomodate the shape of groove 21.

In actual operation, the handle 10 is held by one hand of the user while his other hand places bead 20 in the channel 26. The user then snaps or rolls leg 23 over the ridge 17 so that the ridge will fall into the channel 27. It is also possible for the user to install the handle by initially placing the ridge 17 into the groove 27 while the bead 20 is snapped into the channel 26 by separating the inner legs 22 and 24 respectively. In either event, the handle becomes releasably attached to the beverage can so that the user may then manipulate the can as desired.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A handle for a beverage can comprising:

an elongated handle of a substantially U-shaped configuration and constant thickness;

said handle having a flexible central portion and an upper and a lower connection element outwardly cantilevered at the opposite ends of said central portion in spatial relationship and adapted to move away and towards each other as said central portion is flexed;

said connection elements terminating in free ends, said ends having snap lock attachment means comprising an inner and an outer leg defining a transverse channel therebetween provided in their respective free ends for releasably engaging with the opposite end of the can; and said connection elements being normally biased towards each other;

said inner leg of said lower connection element is flat and of reduced length so as to conform with the adjacent flat surface of the can;

said inner leg of said upper connection element is champered and of reduced length so as to snap lock with a bead carried on the can to yieldably retain the bead in said channel of its associated connection element;

said outer legs are of elongated length so as to project over the respective top and bottom surface of the can; and said handle is composed of a plastic material so as to provide integral spring bias.

2. The invention as defined in claim 1 wherein said central portion is provided with a plurality of convolutions for receiving the finger grip of the user.

* * * * *